US006216766B1

(12) United States Patent
Benni et al.

(10) Patent No.: US 6,216,766 B1
(45) Date of Patent: Apr. 17, 2001

(54) FLUID-TIGHT COUPLING DEVICE FOR A FEEDER PIPE

(75) Inventors: Gianni Benni, Calderara di Reno; Giorgio Muneratti, Polesella, both of (IT)

(73) Assignee: Reynolds Wheels International Ltd., Lugano (CH)

( * ) Notice: Subject to any disclaimer, the term of this patent is extended or adjusted under 35 U.S.C. 154(b) by 0 days.

(21) Appl. No.: 08/555,924

(22) Filed: Nov. 13, 1995

(30) Foreign Application Priority Data

Nov. 30, 1994 (IT) ..... B094A0531

(51) Int. Cl.[7] ..... B22D 18/04
(52) U.S. Cl. ..... 164/306; 164/119
(58) Field of Search ..... 164/306, 119, 164/308, 309

(56) References Cited

U.S. PATENT DOCUMENTS 3,163,897 * 1/1965 Sylvester ..... 164/119
4,995,535 2/1991 Ooya et al. .

FOREIGN PATENT DOCUMENTS

C-1 156 942 5/1964 (DE) .
A-53 279 5/1967 (DE) .
B-1 508 753 4/1969 (DE) .
A-0 379 420 7/1990 (EP) .
573053 * 2/1958 (IT) ..... 164/119
573054 * 2/1958 (IT) ..... 164/306
6-114529 * 4/1994 (JP) ..... 164/306

OTHER PUBLICATIONS

Patent Abstracts of Japan vol. 17 No. 103 (M–1374), Mar. 2, 1993 & JP–A–04 294854 (Toyota Motor) Oct. 19, 1992 *abstract*.

* cited by examiner

*Primary Examiner*—Kuang Y. Lin
(74) *Attorney, Agent, or Firm*—Darby & Darby

(57) ABSTRACT

A pipe conveying molten material upwards from a pressurized receptacle into the mold of a low pressure diecasting machine, positioned on and supported by the receptacle, is secured in a fluid-tight fit by an adjustable coupling device. One end of the pipe extends through the topmost wall of the receptacle to pick up the molten material and the other terminates in a head located externally of the receptacle and tightened together with a seal against the mold. The outer surface of the pipe head has at least one substantially frusto conical portion matched to the surfaces of a plurality of wedges disposed circumferentially around the pipe and mounted on slide ways which can be directed by suitable actuators from an at-rest position to an operating position in which the pipe is subjected to an axial force with the pipe head clamped together with the seal against the machine.

12 Claims, 6 Drawing Sheets

FLUID-TIGHT COUPLING DEVICE FOR A FEEDER PIPE

BACKGROUND OF THE INVENTION

The present invention relates to a device to effect a fluid-tight coupling around a pipe serving to convey molten material, as part of the connection between a low pressure diecasting machine and a pressurizable receptacle in which the molten material is prepared. The device disclosed is well suited for application to a pipe fashioned from fragile material, insertable typically through one wall of the receptacle, which comprises a body having an inlet end that is located internally of the receptacle and a head at the pipe outlet end whose surface can be coupled in fluid-tight association with a mold coupled to the low pressure diecasting machine.

A low pressure diecasting machine of the type in question is mounted on and connected to a receptacle containing molten material in a manner such that the pipe is aligned and connected with the injection nozzles of a mold connected to the machine.

The prior art systems employed in making such a connection, while based on a variety of techniques, are similar inasmuch as all permit removing the machine from the receptacle. In effect, the machine rests on the receptacle during operation and can be moved to a non-operating position whenever the need arises to gain access to the inside of the receptacle. To ensure the features of a removable connection that can be successfully operated, the pressure-tight fit between the nozzles and the front end surface of the head of the pipe is obtained by interposing seals of gaskets of suitable thickness. The efficiency of the sealing action in containing the pressure of the molten material is somewhat critical, given that the tightness of the fit between the front end surface of the pipe and the nozzle of the mold relies only on a suitably strong force of compression.

In practice, this is achieved by packing the space between the machine and the head of the pipe to an overall depth nominally greater than that of the existing gap, so that the fluid-tight barrier will be established by a compressive force provided by the total weight of the low pressure diecasting machine.

Quite apart from the operational inconvenience and the empirical nature of such a system, selection of the optimum condition depends on a process of trial and error. The working principle underlying this method of connection tends to result in a high degree of structural stress on the pipe. In other solutions, the receptacle is forced vertically into association with the diecasting machine through the agency of suitable lifting means, the force in this instance being applied laterally.

Owing to the intense and uncontrollable impact of these stresses, rupture of the pipe frequently occurs, particularly when the pipe, as already intimated, is made of a fragile material, such as silicon nitride or other ceramics typically utilized in the context of low pressure diecasting processes for aluminum alloys.

Conversely, the application of a smaller compressive force to the sealing medium might well diminish the risk of pipe rupture, but would not ensure an efficient sealing action to accommodate the pressure of the fluid flowing at high temperature through the pipe. In short, a solution that succeeds both in avoiding the risk of rupture to the pipe and in ensuring an efficient seal must necessarily involve a compromise between the two opposing requirements outlined above.

OBJECT OF THE INVENTION

Accordingly, the object of the present invention is to overcome the aforementioned drawbacks, providing a solution to the problem of ensuring an efficient sealing action between pipe and mold by adopting a novel arrangement for compressing the interposed sealing medium, and allowing for adjustment of the force by which the sealing action is assured.

SUMMARY OF THE INVENTION

The stated object is realized by a device in which a pipe for conveying molten material can be coupled adjustably and in a pressure-tight fit as part of the connection between a low pressure diecasting machine and a pressurizable receptacle for preparation of the molten material.

The pipe passes through one wall of the receptacle and has a body affording a head coinciding with an outlet end whose front surface can be coupled to the mold of the low pressure diecasting machine together with an interposed sealing medium. The design of the device takes account of the fact that the outer surface of the pipe as supplied by the manufacturer has at least one portion which is angled in relation to the axis of the pipe itself. In a preferred embodiment described below, the outer surface of the pipe comprises a portion of the head that has a substantially frustoconical shape.

The device itself comprises three wedges disposed circumferentially around the pipe between the head and the wall of the receptacle. Each wedge has a surface matched to the aforementioned angled portion of the pipe in such a manner that the surfaces can be coupled together. In addition, the three wedges are mounted slidably on corresponding ways and are thus capable of movement in relation to the wall of the receptacle, transversely to the axis of the pipe through the agency of an actuator means. The movement is brought about between a non-operating at-rest position of the wedges spaced from the pipe, and an operating position of close proximity of the wedges to the pipe in which the wedges apply an axial force such as will tend to draw the pipe outward from the receptacle and, in consequence, cause the head to be clamped together with the sealing medium against the mold of the low pressure diecasting machine. The three wedges are thus able to generate the requisite sealing action, at least across the front end surface of the head, in opposition to the pressure of the molten material flowing along the pipe.

The principal advantage of a device according to the invention is that the optimum clamping force for a given pipe can be determined by a continuous incremental type of adjustment in which the weight of the machine plays no part whatever.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
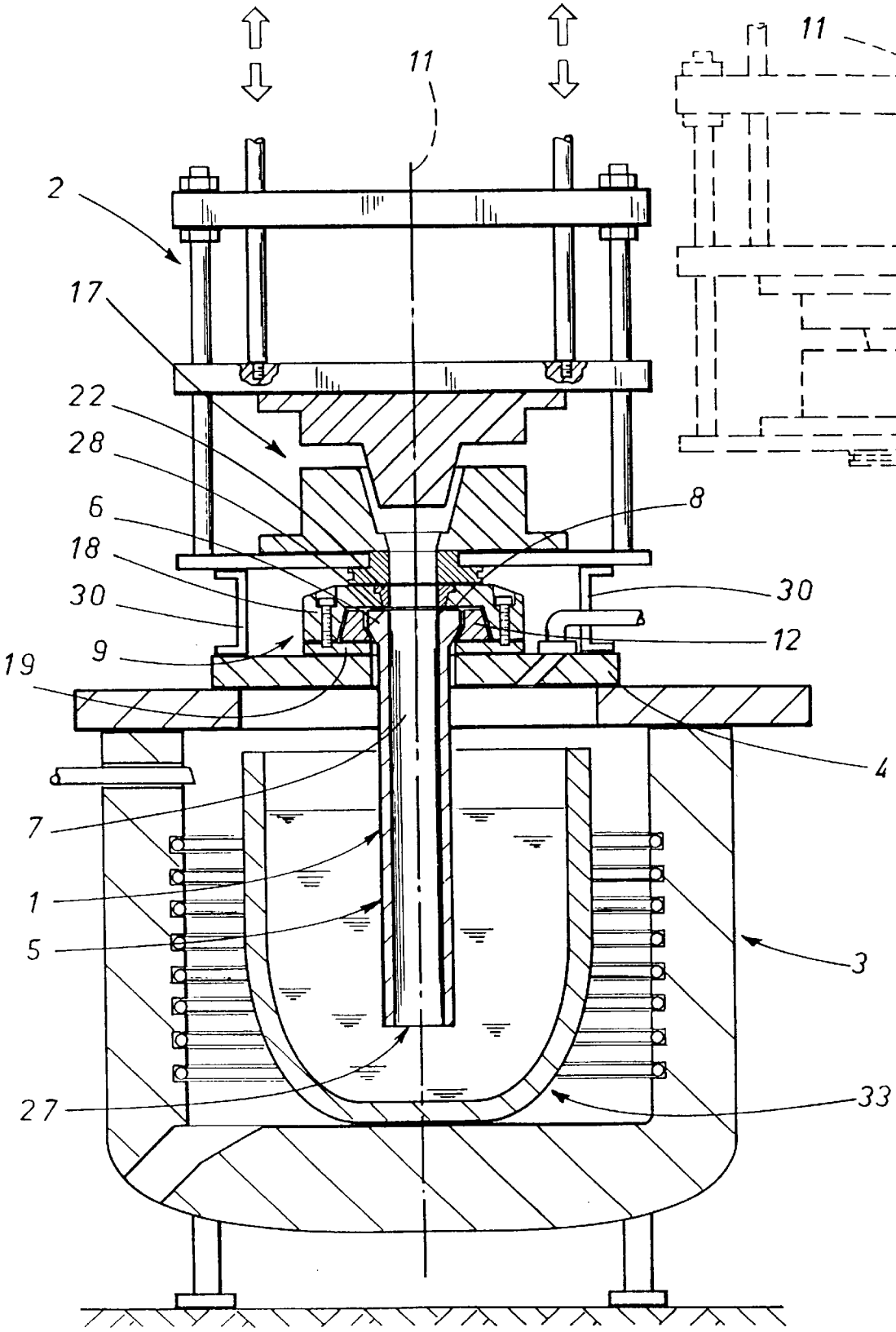
FIG. 1 is an overall sectional view illustrating a device according to the invention, shown fitted to a low pressure diecasting machine associated with a receptacle containing molten material, in which the pipe is shown in a first embodiment.
Figure 1A:
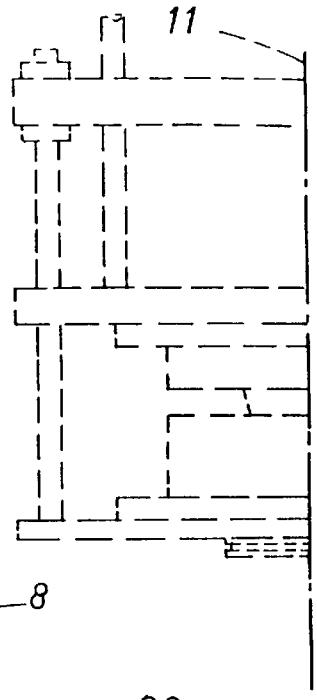
Figure 2:
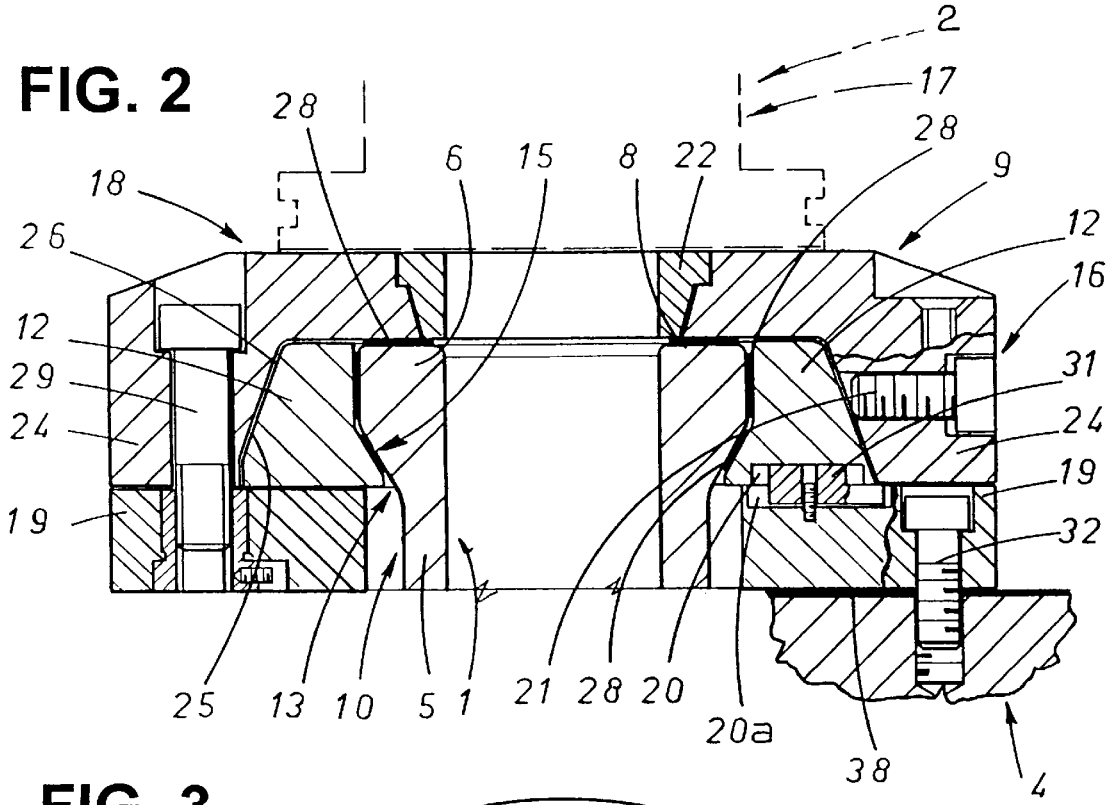
FIG. 2 shows the device according to the invention in a further section, enlarged in relation to FIG. 1 and taken through lines II—II of FIG. 3.

With reference to the accompanying drawings, and to FIGS. 1 and 2 in particular, the present invention relates substantially to an adjustable coupling device 9 by means of which a feeder pipe 1 conveying molten material is connected in a pressure-tight fit to a low pressure diecasting machine 2 associated with a pressurizable receptacle 3 in which the molten material is prepared.

The low pressure diecasting machine 2 is supported during operation by the receptacle 3, of which the top horizontal wall 4 has thereon a set of stands 30 for this purpose. When not in operation, the machine 2 can be removed from the receptacle 3 (see phantom lines in FIG. 1) by a combination of lateral translation and elevation on angled ways, not illustrated in the drawings, in such a way as to afford internal access to the receptacle 3.

The pipe 1 is typically of fragile ceramic material, preferably silicon nitride, and passes through the top horizontal wall 4 of the receptacle 3. Seen in its entirety, the pipe has a body 5 with an inlet end 27 which extends into a crucible 33 positioned within the receptacle 3. The pipe also has a head 6 at an opposite outlet end 7 of which the front surface 8 is designed to locate against a mold 17 fitted to the low pressure diecasting machine 2 with an interposed seal 28 as will be described.

Figure 12:
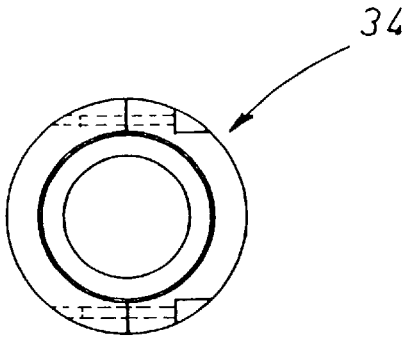
FIGS. 12, 13, 14 and 15 illustrate four alternative embodiments of the pipe.
Figure 12A:
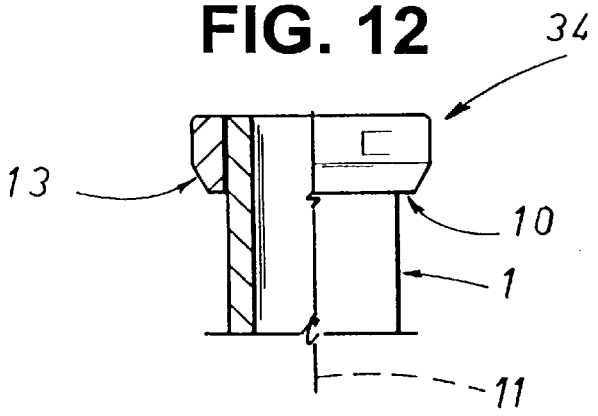
Figure 13:
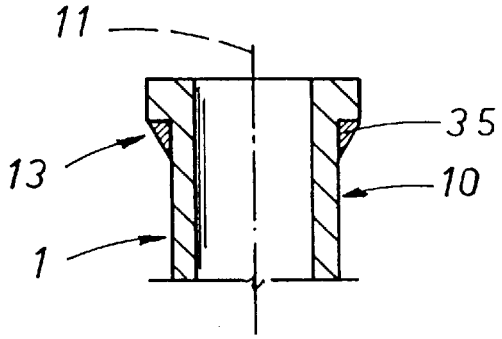
Figure 14:
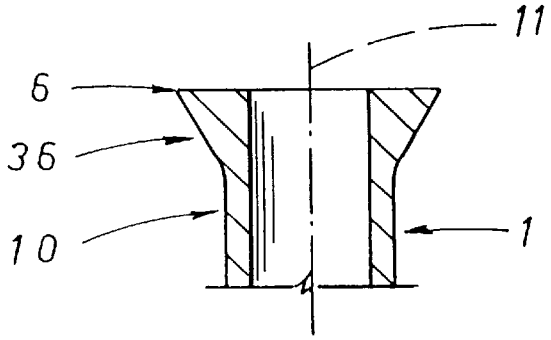

A preferred embodiment of the device 9 (shown in FIG. 2) is designed for use in conjunction with a pipe 1 of which the outer surface 10 has an annular portion 13 of frustoconical shape located at the head end 6, which preferably has an angle of 30° relative to the longitudinal axis 11 of the pipe 1. It will, of course, be sufficient in practice that the annular portion 13 of the outer surface 10 has a different type of taper in relation to the axis 11 of the pipe 1, as indicated in FIGS. 12, 13 and 14. To this end, the pipe 1 shown in FIG. 12 has a separately embodied flange 34 whose outer surface 10 affords the frustoconical annular portion 13. The pipe 1 of FIG. 13 has an enlarged collar with a plain shoulder, the frustoconical portion 13 in this instance provided by a thrust ring 35. In the example of FIG. 14, the entire head 6 of the pipe 1 has a splayed flange 36 of "V" shaped profile which creates the frustoconical portion 13.

Figure 5:
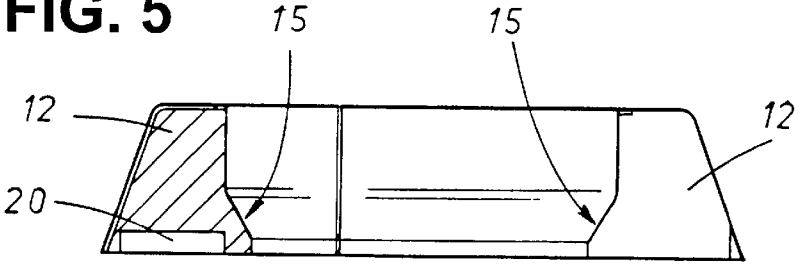
FIG. 4 and FIG. 5 illustrate a first detail of the device viewed respectively in plan and in a section through V—V of FIG. 4.
Figure 4:
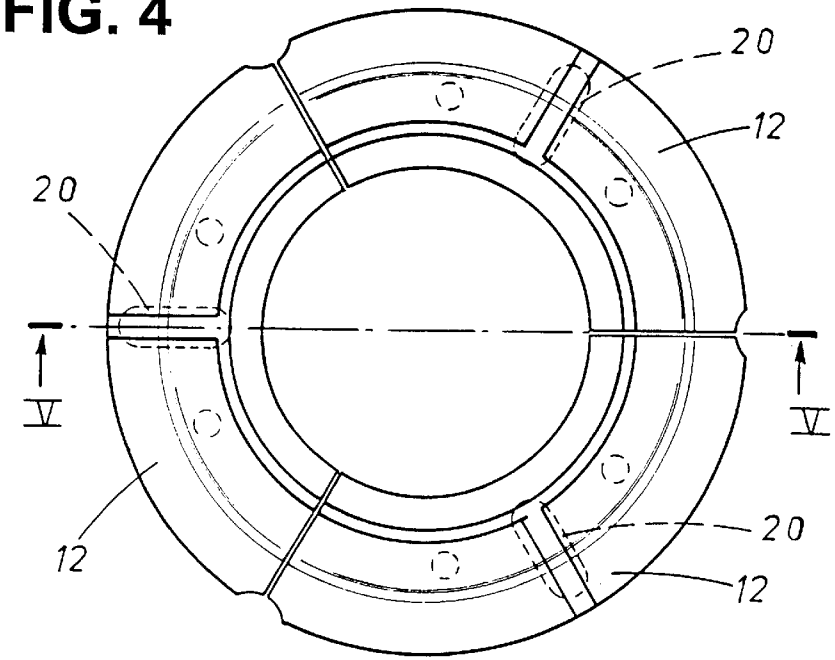

Referring in particular to FIGS. 2, 4 and 5, the device 9 has three identical wedges 12 to be disposed around the head 6 of the pipe 1 at equal angular intervals of 120° and designed to operate between the head 6 of the pipe 1 and the wall 4 of the receptacle 3.

Each wedge 12 has a surface 15 matched to the frustoconical portion 13 of the outer surface 10 of the pipe 1 in such a manner that the three wedges can be coupled circumferentially with the pipe portion 13.

Figure 6:
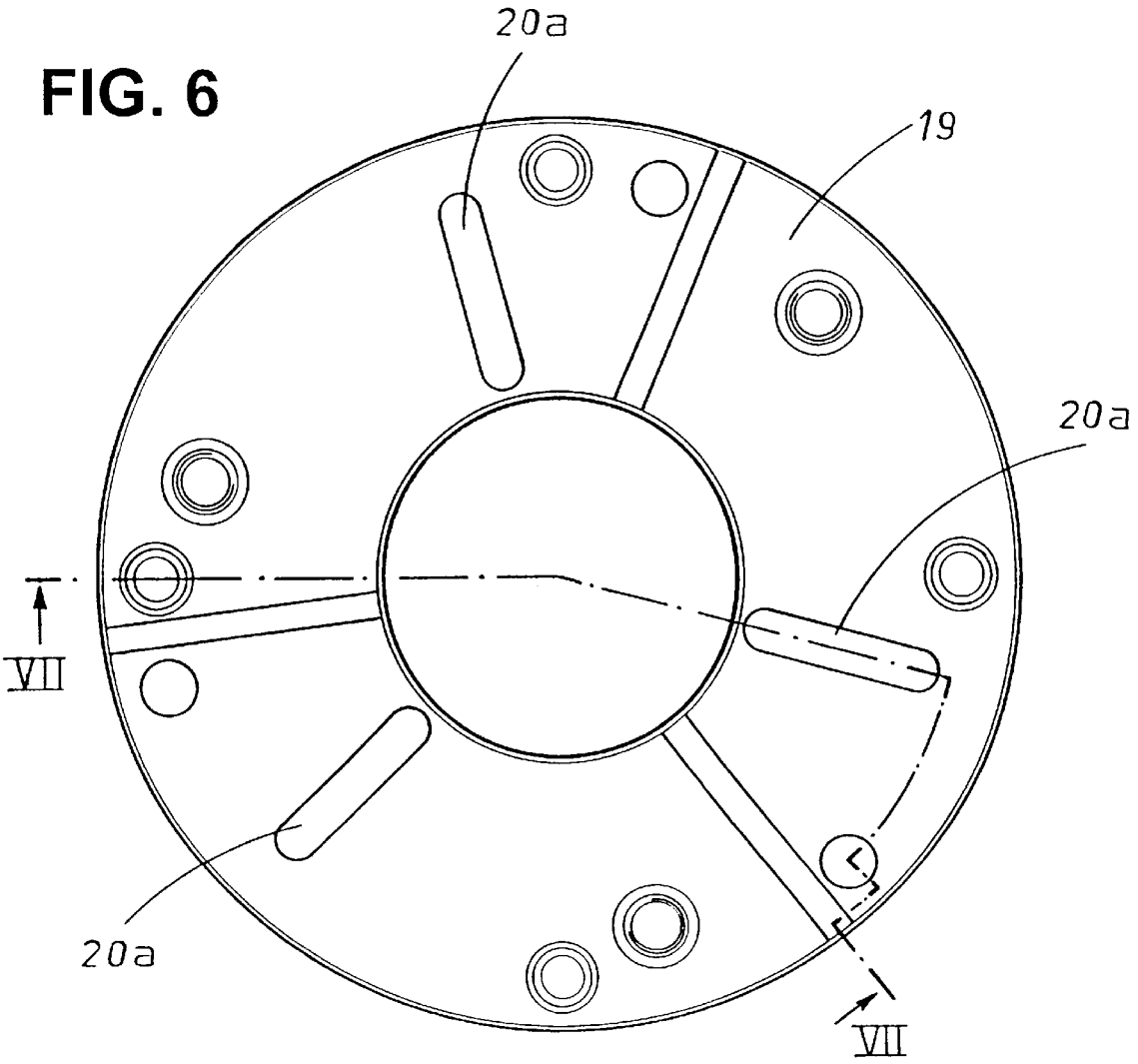
FIG. 6 and FIG. 7 illustrate a second detail of the device viewed respectively in plan and in a section through lines VII—VII of FIG. 6.
Figure 7:
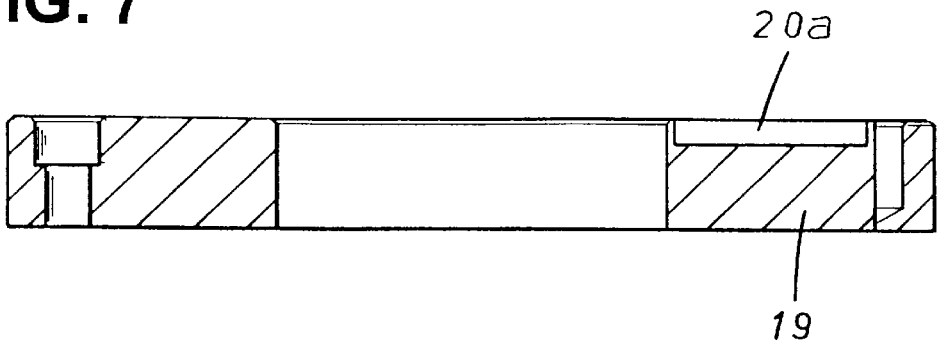
Figure 8:
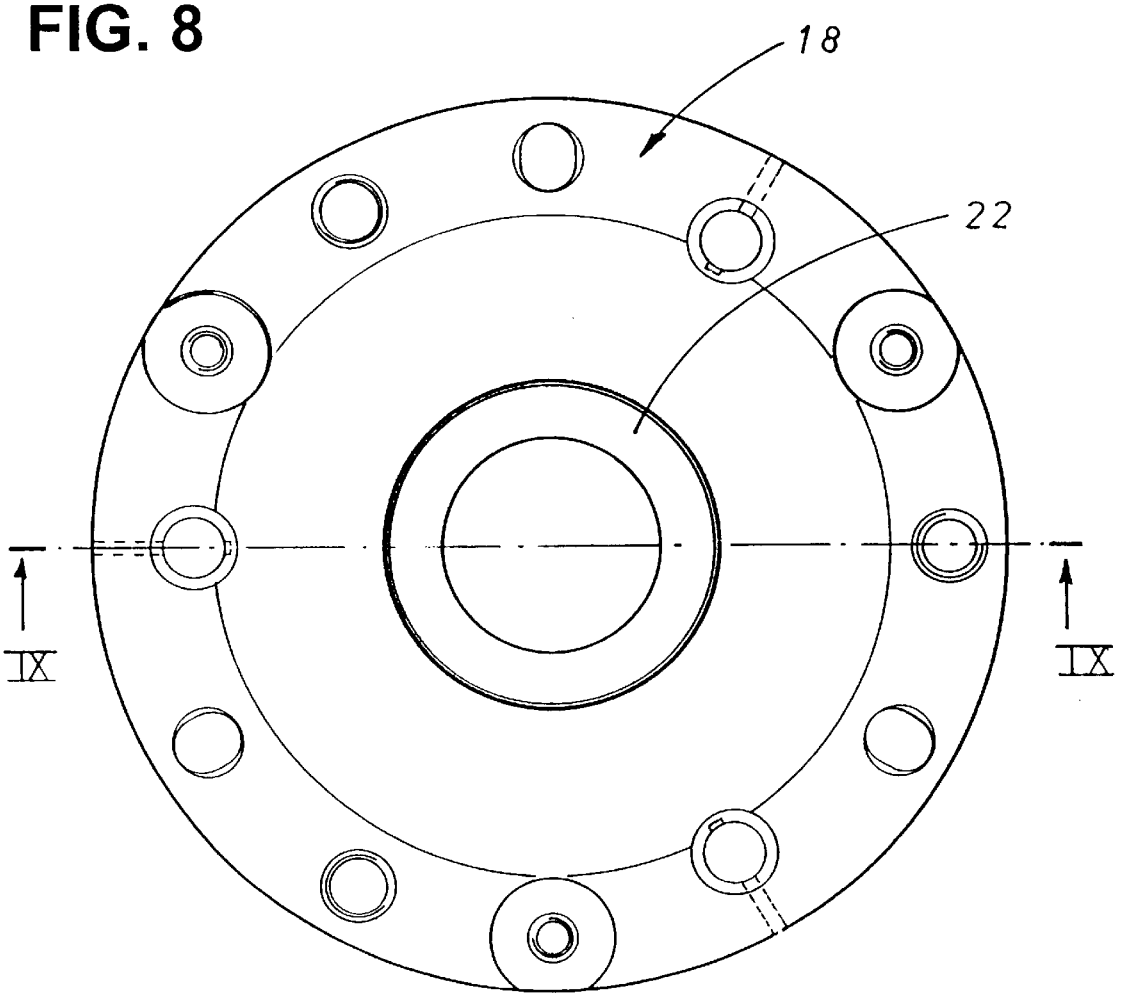
FIG. 8 and FIG. 9 illustrate a third detail of the device viewed respectively in plan and in a section through lines IX—IX of FIG. 8.

In addition, the wedges 12 are mounted slidably to respective slide ways 2 (see FIGS. 6 and 7) formed partly within the wedges themselves and partly, as indicated by the number 20*a*, within a flange 19 by which the entire device 9 is secured to the wall 4 of the receptacle 3. This makes each of the wedges capable of movement in relation to the wall 4 transversely to the axis 11 of the pipe 1 through the agency of a corresponding actuator means 16.

Figure 15:
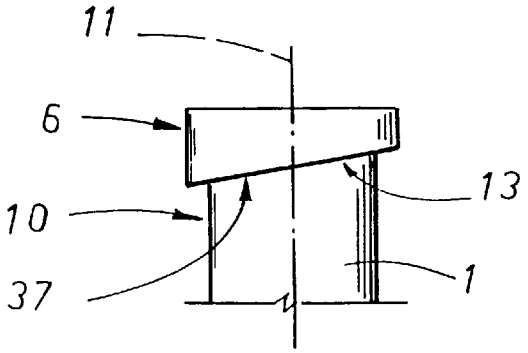

In an alternative embodiment, illustrated in FIG. 15, the head 6 of the pipe 1 has a downwardly directed surface 37 disposed obliquely in relation to the pipe longitudinal axis 11 and performs the same function as the aforementioned frustoconical annular portion 13. More specifically, the downwardly directed surface 37 affords an inclined plane that can be coupled with a wedge 12 mounted in such a way as to operate and interact adjustably with the head 6 essentially in the same manner as described above for other embodiments.

In particular, it is seen from FIG. 2 that the flange 19 is secured to the wall 4 of the receptacle 3 by means of screws 32 with a gasket 38 interposed. In addition, the part 20*a* of the slide way formed in the flange 19 affords a fixed key 31 insertable into the slide way 20 of the wedge 12 serving to guide the sliding movement of the wedge. The device 9 further comprises an annular plate 18 providing a structural interface between the low pressure diecasting machine 2 and the receptacle 3. The plate 18 is positioned coaxially in relation to the pipe 1, between the machine 2 and the head 6, and has a bush 22 of ceramic material disposed in axial alignment with the pipe through which the molten material flows during the injection stage.

Figure 3:
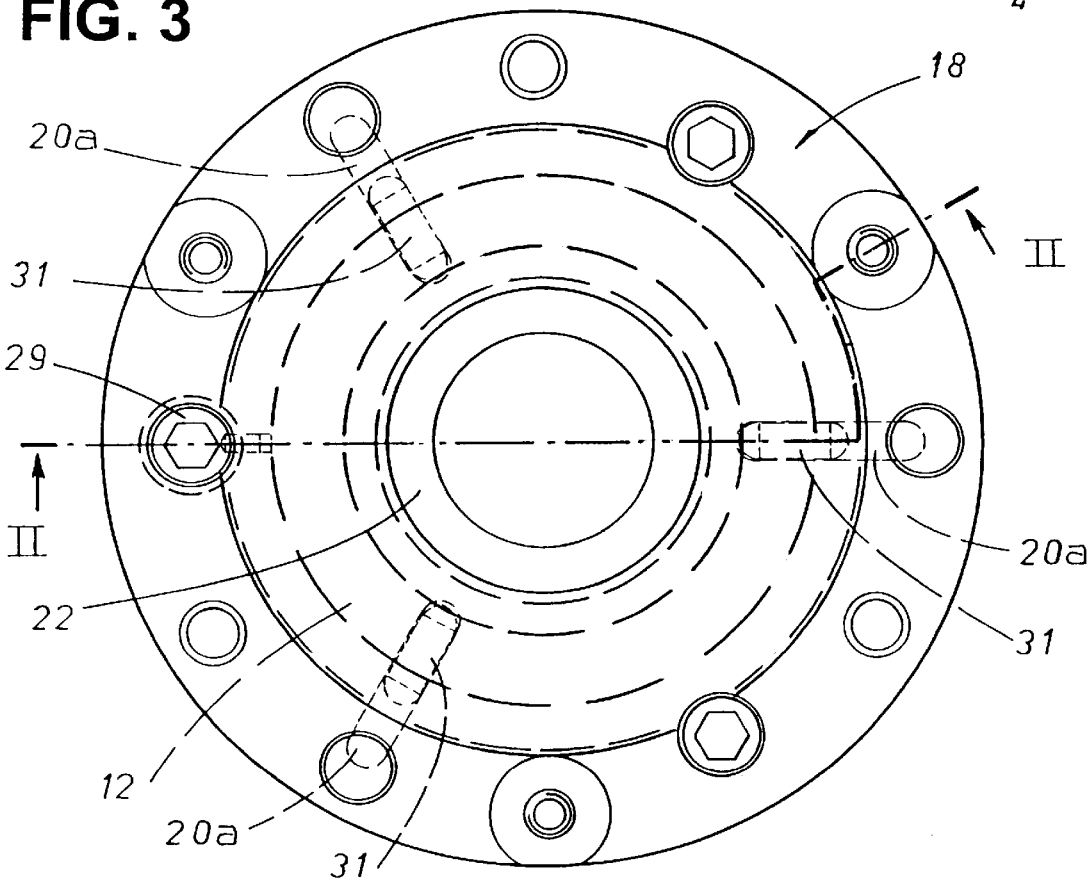
FIG. 3 illustrates the device of FIG. 2 viewed in plan from above.

As indicated in FIGS. 2 and 3, the annular plate 18 is secured to the flange 19 with bolts 29 and has a peripheral rim 24 shaped in such a way as to transmit the structural loads deriving from the force of mass exchanged between the low pressure diecasting machine 2 and the pressurized receptacle 3 on which the machine is supported. In addition, the peripheral rim 24 encompasses the head 6 and the wedges 12, so that there is no structural interaction between these components and the plate 18.

Nonetheless, the peripheral rim 24 of the plate 18 can be coupled with the wedges 12. As seen from FIG. 2, in effect, the rim 24 and the wedges 12 have respective matching frustoconical surfaces 25 and 26 positioned so as to engage one with another when the plate 18 is secured to the receptacle 3, with the result that the wedges 12 are clamped against the head 6 by a force applied at right angles to the axis 11 of the pipe 1. Thus, whenever the annular plate 18 is bolted onto the flange 19, the frustoconical surface 25 of rim 24 is caused to slide against the matching surfaces 26 of the wedges 12, forcing the wedges in their turn to slide along the respective ways 20 and move from an at-rest position distanced from the pipe 1 toward an operating position of close proximity to the pipe 1. In this close-coupled position, and indeed during any further movement in the same direction, the inner surfaces 15 of the wedges will engage on the matching frustoconical portion 13 of the outer surface 10 of the head 6 producing an axial force that tends to lift the pipe 1 from the receptacle 3. The orientation of the taper on the surfaces denoted 25 and 26 is opposite to that of the frustoconical annular portion 13 afforded by the outer surface 10 of the pipe 1, and the angle of inclination also different, for example 20° in the embodiment illustrated. Thus, it is the angled surface 25 of the peripheral rim 24 of the annular plate 18 provides the aforementioned actuator means 16 to drive the wedges 12.

As regards the operation of the device 9, it is seen from FIG. 2 that the action of the flange 18 on the wedges 12 can be optimized by the adoption of actuator means 16 in a wide variety of different yet substantially equivalent solutions; for example, by including setscrews 21 insertable through the peripheral rim 24 of the plate 18 and engaging each of the wedges 12. The wedges can be moved further along the respective slide ways 29 and thereby obtain a fine adjustment of the clamping action applied to the pipe 1.

As a result of the axial force generated through the clamping action, the front end surface 8 of the head 6 of the pipe 1 is driven against and ultimately impeded by the plate 18. Accordingly, the seal 28 can be pinched securely between the head 6 and the plate 18 creating a pressure-tight barrier to the molten material flowing through the pipe 1. Clearly, any leakage of the molten material between the head 6 and the surrounding wedges 12 will be prevented by locating similar seals 28 at least against the frustoconical annular portion 13 extending between the head 6 and the body 5 of the pipe 1.

A device 9 as shown ensures the fluid-tight fit needed to prevent any egress of the molten material from the pipe 1 and of setting the clamping force at the exact values required to produce an efficient seal. This is accomplished without inducing overloads liable to present an excessive risk to the integrity of the pipe 1. Moreover, not only does the weight of the low pressure diecasting machine 2 have no bearing whatever on the clamping force, but the force is applied statically and at a velocity that can be selected and controlled at will. This is in contrast to prior art type solutions where the inevitably high load generated by the weight of the machine 2 is applied instantaneously, hence in the manner of a dynamic load and with particularly adverse consequences for fragile materials.

Figure 10:
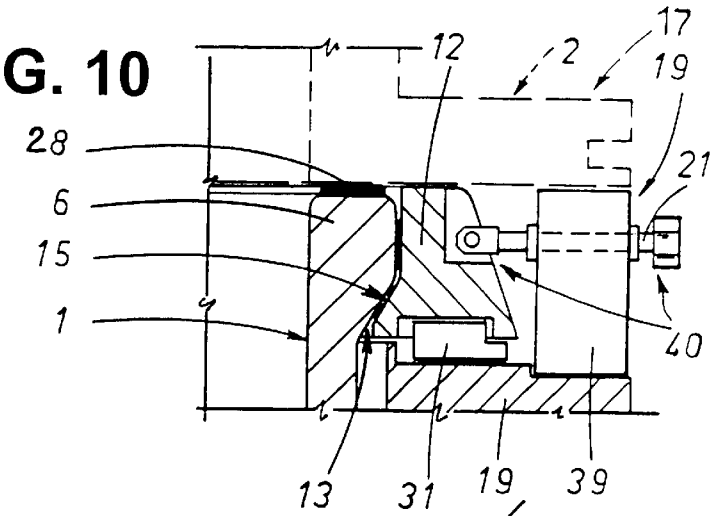
FIG. 10 and FIG. 11 show a detail of the device in an alternative embodiment, illustrated respectively in a partial sectional view and in plan.
Figure 11:
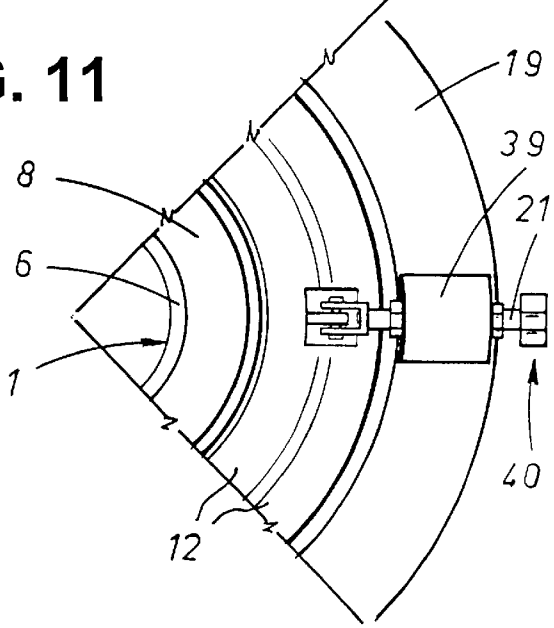

FIGS. 10 and 11 illustrate an alternative embodiment of the device 9 wherein the plate 18 is eliminated and the flange 19 has peripheral projections 39 on which the low pressure diecasting machine 2 rests directly, supported thus by the receptacle 3. The wedges 12 in this instance are clamped against the head 6 of the pipe 1, and the relative surfaces 15 coupled consequently with the frustoconical portion 13 of the outer surface 10, by actuator means 40 comprising a screw 21 operating between the peripheral projection 39 and the wedge 12.

Figure 9:
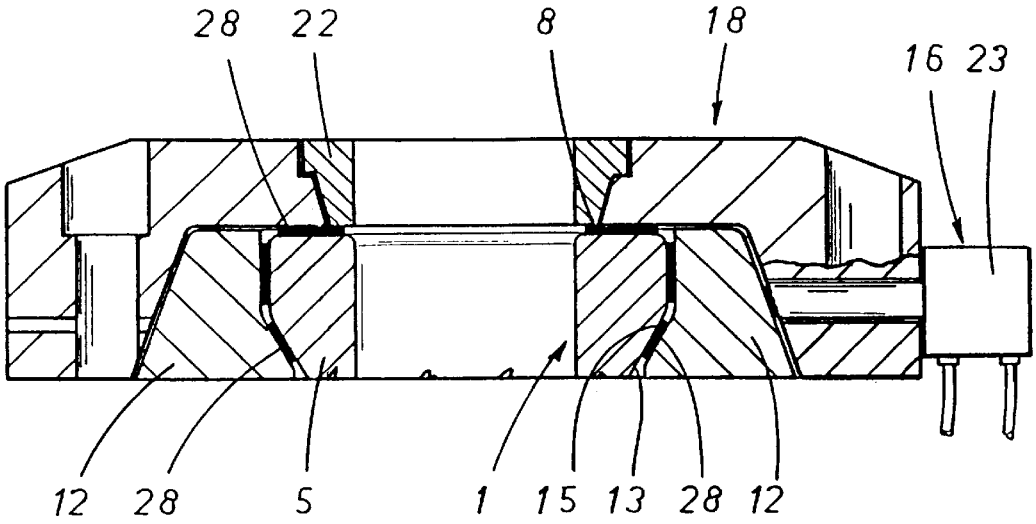

Finally, other possible variations in embodiment of the actuator means 16 include the adoption of fluid power actuators 23 associated with the wedges 12 in place of the screws 21 (see FIG. 9).

What is claimed:

1. A low pressure die casting apparatus including a fluid-tight coupling device for a pipe conveying molten material for the connection of a low pressure diecasting machine to a receptacle containing the molten material, wherein the pipe passes through one wall of the receptacle and has an inlet end extending internally of the receptacle so as to admit the molten material and also a head located externally of the receptacle and having a front end surface to be associated by way of an interposed seal with a mold fitted to the machine, the outer surface of the pipe head having at least one portion which is angled in relation to the pipe longitudinal axis, the device comprising at least one wedge for operating between the pipe head and the wall of the receptacle and having a surface matched to the angled portion of the pipe head outer surface so as to interact adjustably therewith, said at least one wedge being mounted in a side way and capable of movement with respect to the wall of the receptacle transversely to the pipe longitudinal axis by an actuator means between a non-operating position spaced from the pipe and an operating position of close proximity to the pipe in which the surface of the wedge is coupled to the pipe head at least one angled portion, applying an axial force by which the pipe is caused to move away from the receptacle and the head tightened against the low pressure diecasting machine and against the interposed seal, producing a tight fit at least across the head front end surface to contain the pressure of the molten material flowing through the pipe.

2. A device as in claim 1, comprising an annular plate providing a structural interface between the low pressure diecasting machine and the receptacle disposed coaxial with the pipe and positioned between the low pressure diecasting machine and the pipe so as to engage the head and thus oppose the axial action generated through the pipe by the movement of the said at least one wedge toward the operating position.

3. A device as in claim 2, wherein the annular plate has a peripheral rim and proportioned to encompass the pipe head and the wedge.

4. A device as in claim 3, wherein the peripheral rim of the annular plate has an angled inner surface matched to a correspondingly angled outer surface of the at least one wedge, so that when the plate is secured to the receptacle, said plate angled inner surface and said wedge outer surface will be coupled mutually to allow clamping of the wedge against the head of the pipe in a direction transverse to the pipe axis, the angled inner surface of the plate acting as the actuator means by which the wedge is operated.

5. A device as in claim 4, wherein the two mutually coupled surfaces of the plate and wedge are angled oppositely to the surface of the wedge for engaging the at least one angled portion of the pipe head outer surface.

6. A device as in claim 1, comprising three independent wedges disposed circumferentially and peripherally around the pipe head.

7. A device as in claim 6, wherein the wedges are identical and distributed around the pipe head at equal angular distances.

8. A device as in claim 1, further comprising an annular plate providing a structural interface between the low pressure diecasting machine and the receptacle, and a flange interposed between the plate and the wall of the receptacle to secure the plate to the wall, wherein the flange has thereon one part of at least one slide way accommodating the movement of a wedge.

9. A device as in claim 1, wherein actuator means comprises at least one screw to engage and move the wedge along the slide way.

10. A device as in claim 1, wherein the actuator means comprises a fluid power actuator to move the wedge along the slide way.

11. A device as in claim 8, further comprising a flange presenting at least one peripheral projection on which the low pressure diecasting machine rests to be supported by the receptacle, and actuator means to operate between the peripheral projection and the at least one wedge to clamp the wedge against the head of the pipe, the surface of the wedge being coupled with the angled portion of the pipe head outer surface.

12. A device as in claim 2, wherein the annular plate further comprises a ceramic bush in coaxial alignment with the pipe.

* * * * *

UNITED STATES PATENT AND TRADEMARK OFFICE

CERTIFICATE OF CORRECTION

PATENT NO. : 6,216,766 B1
DATED : April 17, 2001
INVENTOR(S) : Gianni Benni and Giorgio Muneratti It is certified that error appears in the above-identified patent and that said Letters Patent is hereby corrected as shown below:

Title page,
Item [30] Foreign Application Priority data, change "B094A0531" to -- B094A00053 --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,216,766 B1
DATED : April 17, 2001
INVENTOR(S) : Gianni Benni and Giorgio Muneratti It is certified that error appears in the above-identified patent and that said Letters Patent is hereby corrected as shown below:

Title page,
Item [30], Foreign Application Priority Data, change "B094A00053" (as in the Certificate of Correction issued November 13, 2001), to -- B094A0531 --.

Signed and Sealed this

Twenty-sixth Day of February, 2002

*Attest:*

*Attesting Officer*

JAMES E. ROGAN
*Director of the United States Patent and Trademark Office*